US005250408A

United States Patent [19]

Chang et al.

[11] Patent Number: 5,250,408

[45] Date of Patent: Oct. 5, 1993

[54] CHLORIDE CONTAINING TABULAR GRAINS WITH HOLES AND PROCESS FOR THEIR PREPARATION

[75] Inventors: Yun C. Chang; Joe E. Maskasky, both of Rochester, N.Y.

[73] Assignee: Eastman Kodak Company, Rochester, N.Y.

[21] Appl. No.: 898,612

[22] Filed: Jun. 15, 1992

[51] Int. Cl.[5] ..... G03C 1/005; G03C 1/035

[52] U.S. Cl. ..... 430/569; 430/567

[58] Field of Search ..... 430/567, 569

[56] References Cited

U.S. PATENT DOCUMENTS 4,710,455 12/1987 Iguchi et al. ..... 430/567
4,713,323 12/1987 Maskasky ..... 430/569
5,045,443 9/1991 Urabe ..... 430/567

*Primary Examiner*—Charles L. Bowers, Jr.
*Assistant Examiner*—Mark F. Huff
*Attorney, Agent, or Firm*—Carl O. Thomas

[57] ABSTRACT

The present invention is directed to a process of precipitating, for use in photography, a high aspect ratio silver halide tabular grain emulsion employing a dispersing medium and silver chlorobromide or silver chlorobromoiodide grains, wherein at least 50 percent of the tabular silver halide grains have a centrally located hole.

24 Claims, 6 Drawing Sheets

3 μM

10 μM

1 μM

10 μM

10 μM

1 μM

CHLORIDE CONTAINING TABULAR GRAINS WITH HOLES AND PROCESS FOR THEIR PREPARATION

FIELD OF THE INVENTION

The present invention relates to processes for precipitating radiation sensitive tabular grain emulsions for use in photography.

BACKGROUND OF THE INVENTION

The most commonly employed photographic elements are those which contain a radiation sensitive silver halide emulsion layer coated on a support. Although other ingredients can be present, the essential components of the emulsion layer are radiation sensitive silver halide microcrystals, commonly referred to as grains, which form the discrete phase of the photographic emulsion, and a vehicle, which forms the continuous phase of the photographic emulsion.

Recently the photographic art has turned its attention to high aspect ratio tabular grain emulsions, herein defined as those in which tabular grains having an aspect ratio greater than 8:1 account for greater than 50 percent of the total grain projected area. The aspect ratio of the grains is determined by dividing the grain thickness by the grain diameter. The term grain diameter as used herein is its equivalent circular diameter—that is, the diameter of a circle having an area equal to the projected area of the grain. Grain dimensions can be determined from known techniques of microscopy. Tabular grain emulsions can offer a wide variety of advantages, including reduced silver coverages, thinner emulsion layers, increased image sharpness, more rapid developability and fixing, higher blue and minus blue speed separations, higher covering power, improved speed-granularity relationships, reduced crossover, less reduction of covering power with full forehardening, as well as advantages in image transfer. Research Disclosure, Vol. 225, January 1983, Item 22534, is considered representative of these teachings.

In almost every instance, the advantages of high aspect ratio tabular grain emulsions are enhanced by limiting the thickness of the tabular grains. High aspect ratio tabular grain silver chlorobromide emulsions having tabular grain thicknesses well below 0.3 μm have been formed, and corresponding silver bromoiodide emulsions have been recently produced.

One possible drawback to tabular shaped grains is that they lie parallel when coated on a photographic paper or film support. Consequently, it is conceivable that overlapping layers could inhibit, to some degree, the free flow of developer solution.

By incorporating holes into the tabular grains, developer solution could be made to pass through the holes, resulting in more uniform development.

U.S. Pat. No. 4,713,323 to Maskasky discloses a process for preparing tabular grain emulsions. Although it does not appear to be a purpose of this patent, and therefore is incidental, FIG. 3 of Maskasky shows several grains having holes therein. However, the percentage of total grains having holes in this figure is very small.

U.S. Pat. No. 5,045,443 to Urabe discloses tabular silver halide grains wherein at least 30 percent of these grains have an indentation or space in their central portion. In the process disclosed by Urabe, the halogen composition of the grain is arranged so that the solubility of the center of the grain is higher than that of the surrounding portion. The central portion is then dissolved using a conventional silver halide solvent such as thiocyanate, leaving a centrally located hole. To make AgClBr grains, for example, Urabe teaches producing a grain in which the central portion is AgCl and the outer portion is AgClBr. The central AgCl portion is then dissolved using conventional silver halide solvents, leaving an AgClBr grain with a centrally located hole. The conventional ripening agents and fixing type solvents used to dissolve the more soluble halide portion of include, for example, thiocyanate, ammonia, thioether, and thiourea.

SUMMARY OF THE INVENTION

In accordance with the present invention, a method is provided for producing a radiation sensitive emulsion which includes a dispersing medium and silver halide grains having a total projected area of which at least 50% is provided by tabular silver chlorobromide grains having a thickness of less than 0.3 μm, a diameter of at least 0.6 μm, and a mean aspect ratio greater than 8:1, wherein the silver halide tabular grains are bordered by opposed, substantially parallel {1111} major crystal faces and at least 50% of the tabular silver halide grains have a centrally-located hole connecting the substantially parallel {111} major crystal faces, wherein the centrally-located hole has a diameter of at least 0.4 μm. The method is particularly useful for providing silver chlorobromide grains having a high chloride content.

The method involves first providing an emulsion containing tabular silver chlorobromide or chlorobromoiodide grains having a center portion and a peripheral portion surrounding said center portion, wherein the peripheral portion is more soluble than the center portion. After the initial tabular grain is formed, a quantity of grain protecting material is added to the emulsion to adsorb onto the peripheral portion of the silver chlorobromide grains.

A chloride-containing material is then added to the emulsion, causing the center portion to dissolve and create a hole in the silver chlorobromide grain. The chloride-containing material may be a chloride-containing salt, such as, for example, an alkali, alkaline earth, or ammonium salt. A preferred chloride-containing material is sodium chloride. By varying the precipitation process parameters, the size and shape of the resultant hole can be controlled.

DETAILED DESCRIPTION OF THE INVENTION

Figure 1:
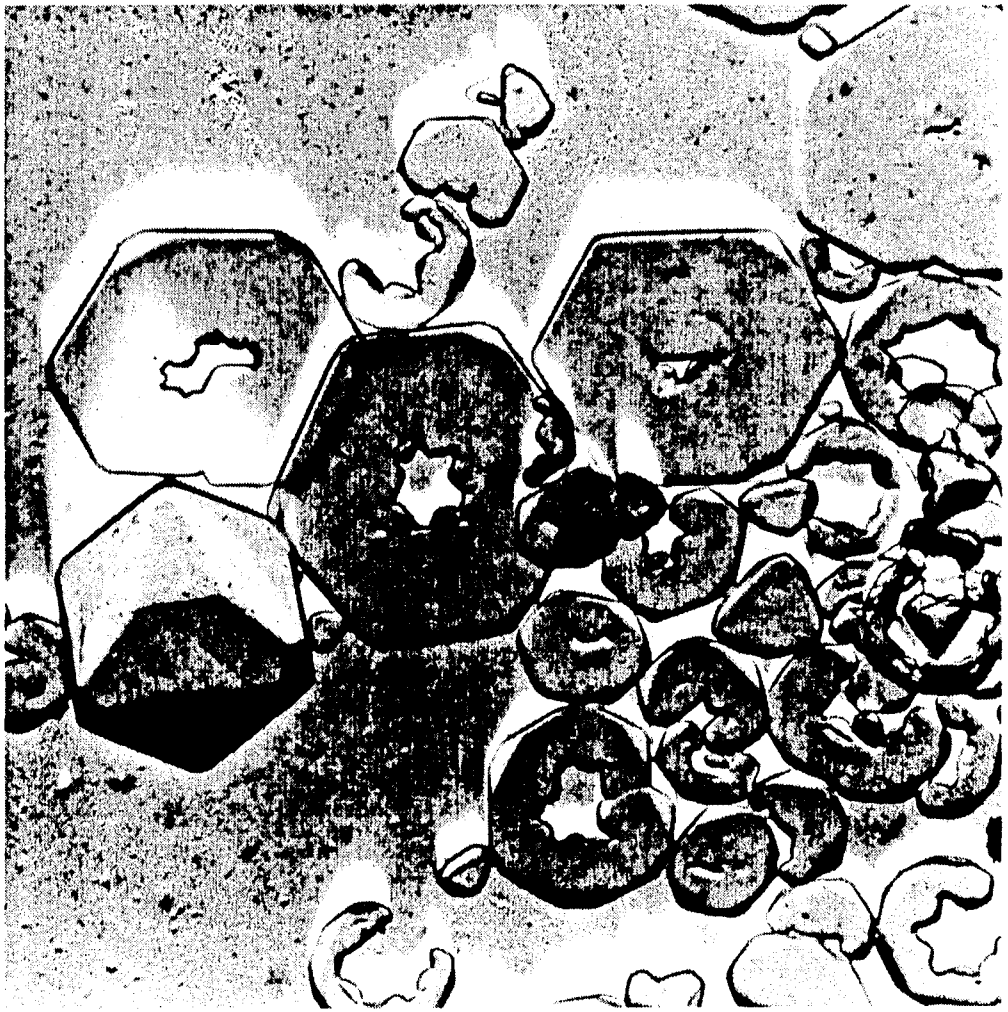
FIG. 1 is a carbon replica micrograph of silver halide grains produced in accordance with the method disclosed in Example 1.

It has been discovered that tabular silver halide grains can be produced wherein at least 50 percent of the grains have a centrally located hole connecting the substantially parallel {111} major crystal faces. More surprisingly, it has been discovered that such grains can be produced by first forming a grain having central composition and an outer periphery composition surrounding the central portion, wherein the higher solubility composition is actually on the periphery of the grains.

The process involves first forming a grain having a central portion and a surrounding peripheral portion, wherein the central portion has a lower solubility than the peripheral portion. A quantity of grain protecting material is then added to the precipitation process, such that the more soluble outer peripheral portion is protected. Suitable grain protecting materials, as the term is used herein, must have a greater affinity for adsorbing on the outer (more soluble) periphery portion and further must be capable of "protecting" the outer portion from dissociating prior to the central portion. Chemical compounds which have shown a particular affinity for use as grain protecting materials are materials having a purine type molecular structure. Particularly preferred grain protecting compounds are xanthine, 7-azaindole, adenine and 4,5,6-triaminopyrimidine.

Another material suitable as a grain protecting material has the following formula:

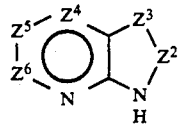

where $Z^2$ is —C($R^2$)=or —N=;

$Z^3$ is —C($R^3$)=or —N=;

$Z^4$ is —C($R^4$)=or —N=;

$Z^5$ is —C($R^5$)=or —N=;

$Z^6$ is —C($R^6$)=or —N=;

with the proviso that no more than one of $Z^4$ $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

Another material suitable as a grain protecting material has the formula:

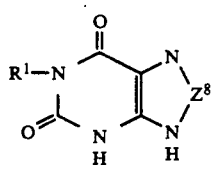

where $Z^8$ is —C($R^8$)=or —N=;

$R^8$ is H, $NH_2$ or $CH_3$; and $R^1$ is hydrogen or a hydrocarbon containing from 1 to 7 carbon atoms. The grain protecting material is not a 2-hydroaminoazine.

Another suitable grain protecting material is a 2-hydroaminoazine of the formula:

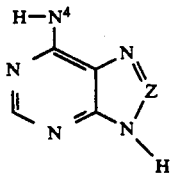

where $N^4$ is an amino moiety and

Z represents the atoms completing a 5 or 6 member ring.

Subsequently, a quantity of a chloride-containing material is added to the emulsion, which causes the halide in the lower solubility center portion to leave the central portion and deposit on the peripheral portion, creating a hole in the tabular grain. The process is suitable for preparing tabular silver chlorobromide grains, particularly those having high chloride content, such as, for example, those having greater than 60 mole percent chloride. More preferably, the chlorobromide grains disclosed herein contain those having greater than at least 80 mole percent chloride, and most preferably the grains contain at least 90 mole percent chloride.

The process is also suitable for forming silver chlorobromoiodide grains, particularly those having high chloride content (i.e., 60 to 99 mole percent chloride). With regard to silver chlorobromoiodide grains, a particularly preferred chloride content is greater than 90 mole percent, and a particularly preferred chloride to bromide to iodide ratio is approximately 91 mole percent chloride, 8 mole percent bromide, and one percent iodide.

In accordance with a preferred embodiment of the present invention to form tabular high chloride content silver chlorobromide grains having holes therein, the precipitation reaction vessel is initially charged with a chloride containing and a bromide containing material, thereby providing a supply of chloride and bromide ions. The solubility of silver halide ranges from AgCl, which is the most soluble silver halide ($pK_{sp}=9.75$), to the less soluble AgBr ($pK_{sp}=12.31$), to the least soluble halide, AgI ($pK_{sp}=16.09$). Of course, mixtures of these halides will result in intermediate solubilities. For a further explanation of silver halide solubility, see "The Theory of the Photographic Process" (4th Edition), by James, Macmillan Publishing Co., Inc. Since silver bromide and silver iodide are markedly less soluble than silver chloride, it is appreciated that bromide and/or iodide ions if introduced into the reaction vessel will be incorporated in the grains in preference to the chloride ions. Thus, when a silver containing material is added to the reaction vessel, the bromide reacts preferentially with the silver to form a grain of substantially AgBr with trace amounts of chloride. The reaction vessel contains an initial bromide to chloride ratio which results in the bromide ions being used up prior to the chloride ions. Once the free bromide in the reactor is used up, only the chloride is left to react with the silver. Consequently, a substantially AgCl portion forms around the AgBrCl grain, thereby creating a grain having a silver bromochloride central portion and an outer peripheral portion consisting primarily of AgCl. The solubility of AgCl is greater than that of AgBr or AgBrCl. Consequently, the resultant grain at this point in time consists of a higher solubility outer periphery region which surrounds a relatively lower solubility central portion.

A grain protecting material such as adenine is then added to the reaction vessel. Adenine preferentially adsorbs onto the outer AgCl portion of the grain, rather than the central AgBrCl portion of the grain.

The centrally located hole is formed by adding a concentrated chloride containing solution after the above described grain formation and incorporation of a grain protecting material. The addition of the concentrated chloride containing solution is commonly referred to as a chloride ion "dump". The driving mechanism involved in tile hole formation step is believed to be two-fold. First, the second law of thermodynamics states that it is a natural tendency of a system to maximize its own entropy. Consequently, the bromide rich center should tend to redistribute itself to other parts of the crystal, which is bromide deficient, in order to maximize the entropy of the resultant grain. Second, by coating the outer portion of the grain with a grain protecting material, such as adenine, it is believed that the halides located in the outer periphery are more protected than the halides located in the central portion. Consequently, when the chloride containing solution is added as mentioned above, the bromide ions in the central portion redistribute to the peripheral portion, thereby leaving a hole in the center of most of the grains. Preferably, the addition of the concentrated chloride containing material (the chloride dump) should result in an increase in chloride ion concentration such that the pCl of the reaction vessel undergoes a drop of at least 0.05. More preferably, the chloride ion dump should result in a pCl drop of 1.0 or more.

While tabular grains having centrally located holes can be produced using the precipitation procedures set forth above, known grain separation techniques, such as differential settling and decantation, centrifuging, and hydrocyclone separation, can, if desired, be employed. An illustrative teaching of hydrocyclone separation is provided by Audran et al. U.S. Pat. No. 3,326,641.

The thin tabular grain emulsions can be put to photographic use as precipitated, but are in most instances adapted to serve specific photographic applications by procedures well known in the art. Conventional hardeners can be used, as illustrated by *Research Disclosure*, Item 17643, cited above, Section X. The emulsions can be washed following precipitation, as illustrated by Item 17643, Section 11. The emulsions can be chemically and spectrally sensitized as described by Item 17643, Sections III and IV; or as taught by Kofron et al. U.S. Pat. No. 4,439,520. The emulsions can contain antifoggants and stabilizers, as illustrated by Item 17643, Section VI.

The emulsions of this invention can be used in otherwise conventional photographic elements to serve varied applications, including black-and-white and color photography, either as camera or print materials; image transfer photography; photothermography; and radiography. The remaining sections of *Research Disclosure*, Item 17643; illustrate features particularly adapting the photographic elements to such varied applications.

The tabular silver halide grains formed in accordance with the invention herein generally have a total projected area of which at least 50 percent is provided by tabular silver halide grains having a thickness of less than 0.3 micrometer (hereinafter also subsequently referred to as micron or μm), a diameter of at least 0.6 μm, and a mean aspect ratio greater than 8:1, wherein at least 50 percent of the silver halide tabular grains have a centrally-located hole connecting the opposed, substantially parallel {111} major crystal faces, and the centrally located hole has a diameter of at least 0.4 μm.

The preferred emulsions prepared according to the present invention are those in which the tabular grains have a thickness of 0.2 μm or less, and an aspect ratio of at least 12:1. Preferably, the tabular grains account for greater than 70 percent of the total grain projected area. Preferably, at least 75 percent and, more preferably, at least 85 percent of the tabular silver halide grains have a centrally-located hole.

In addition to the initial chloride and bromide ion concentration in the reaction vessel, it is additionally contemplated to employ a gelatino-peptizer. The invention is operable with all forms of gelatin, and therefore is not limited to any form of gelatin or any level of methionine.

Specific useful forms of gelatin and gelatin derivatives can be chosen, for example from among those disclosed by Yutzy et al. U.S. Pat. Nos. 2,614,928 and 2,614,929; Lowe et al. U.S. Pat. Nos. 2,614,930 and 2,614,931; Gates U.S. Pat. Nos. 2,787,545 and 2,956,880; Ryan U.S. Pat. No. 3,186,846; Dersch et al. U.S. Pat. No. 3,436,220; Maskasky U.S. Pat. No. 4,713,320; Maskasky U.S. Pat. No. 4,713,323; King et al. U.S. Pat. No. 4,942,120; and Luciani et al. U.K. Pat. No. 1,186,790.

Except for the distinguishing features discussed above, precipitations according to the invention can take conventional forms, such as those described by *Research Disclosure*, Vol. 176, December 1978, Item 17643, Section I, or U.S. Pat Nos. 4,399,215; 4,400,463; and 4,414,306, cited above.

Modifying compounds can be present during emulsion precipitation. Such compounds can be added initially in the reaction vessel or can be added along with one or more of the peptizer and ions identified above. Modifying compounds, such as compounds of copper, thallium, lead, bismuth, cadmium, zinc, middle chalcogens (i.e., sulfur, selenium, and tellurium), gold, and Group VIII metals, can be present during precipitation, as illustrated by Arnold et al. U.S. Pat. No. 1,195,432; Hochstetter U.S. Pat. No. 1,951,933; Trivelli et al. U.S. Pat. No. 2,448,060; Overman U.S. Pat. No. 2,628,167; Mueller et al. U.S. Pat. No. 2,950,972; Sidebotham U.S. Pat. No. 3,488,709; Rosecrants et al. U.S. Pat. No. 3,737,313; Berry et al. U.S. Pat. No. 3,772,031; Atwell U.S. Pat. No. 4,269,927; and *Research Disclosure*, Vol. 134, June 1975, Item 13452. It is also possible to introduce one or more spectral sensitizing dyes into the reaction vessel during precipitation, as illustrated by Locker et al. U.S. Pat. No. 4,225,666.

It is important to note that once an emulsion has been prepared as described above any conventional vehicle, additives including other gelatins can be introduced while still realizing all of the advantages of the invention. Other useful vehicle materials are illustrated by *Research Disclosure*, Item 17643, cited above, Section IX.

EXAMPLES

The invention can be better appreciated by reference to the following specific examples. In each of the examples a reaction vessel equipped with a stirrer was used. The contents of the reaction vessel were stirred vigorously during the entire precipitation process. Examples 1-9 utilize adenine as a grain protecting material, along with some novel precipitation techniques to produce predominantly chloride silver chlorobromide tabular grains having different size, shape and distribution of holes in the middle of those grains. Examples 10 and 11 are control example provided for comparison. Example 12 utilizes 4,5,6-triaminopyrimidine as a grain protecting material. The temperature of all the precipitations was held at 40° C.

The chloride ion concentration was monitored during the precipitation process. During the initial charging of the reaction vessel pCl was approximately 0. Immediately prior to the chlorine ion dump the pCl was approximately 0.036. Immediately after the chlorine ion dump the pCl dropped to approximately −0.08. At the end of the precipitation process, the pCl of the emulsion was approximately 0.115.

Grain characteristics of the various emulsions prepared in the examples were determined from photomicrographs and are summarized in Table I below. The heading Cl/Br ratio refers to the chloride to bromide ratio in the resultant silver halide grain. Hole area per grain refers to the cross-sectional area of the hole divided by the cross-sectional area of the entire tabular grain. Hole Percent refers to the percentage of grains that have holes. Hole Size refers to the maximum size of the resultant holes. The heading pH refers to the pH of the reaction vessel which was maintained throughout the process.

Example 1

The reaction vessel was charged with 6000 grams of distilled water containing 90 gram of oxidized gelatin (which contained 2.7 micro mole of methionine per gram of gelatin), 0.5 Molar $CaCl_2 \cdot 2H_2O$ and 9.3 grams of NaBr. The pH was adjusted to 4.0 at 40° C. and maintained at that value throughout the precipitation by addition of NAOH or $HNO_3$. Three liters of 0.5M $AgNO_3$ solution was added to the reaction vessel. The first 0.3 percent of the total amount of $AgNO_3$ was added over a 1 minute period. The addition rate of $AgNO_3$ was then linearly accelerated over an additional period of 55 minutes (9.32×from start to finish) during which time the remaining 99.7-percent of the $AgNO_3$ was consumed. In addition, 30 CC of 37 mM adenine additions were made after 4 minutes, 10 minutes and 28 minutes of the precipitation, and 378 CC of 3M $CaCl_2$ (i.e., a chlorine ion "dump") was added 10 minutes after precipitation started. During the addition of adenine and $CaCl_2$ solutions, silver flow was stopped for 1 minute to allow the additions to be uniformly mixed. A total of 1.5 moles of Ag halide were precipitated. Greater than 90 percent of the grains had a centrally located hole of irregular shape.

FIG. 1 is a carbon replica micrograph of the resulting AgClBr (6 percent bromide) grains, illustrating irregular shaped holes. A summary of the precipitation conditions and grain characteristics of the emulsion are summarized in Table I.

Examples 2, 3 and 4

Examples 2 through 4 were prepared using the same procedure set forth in Example 1 above, except the pH was maintained at 5 and the initial chloride to bromide ratio was changed, as illustrated in Table I, resulting in a different chloride to bromide ratio in the resulting grain. It should be noted that the parameters of Example 4 resulted in circular, rather than irregular (like Examples 1, 2, and 3) holes.

Example 5

This emulsion was prepared as described in Example 1, except that 62 grams of NaBr, and 3.94 mMoles of adenine were added initially to the reaction vessel solution. The pH was adjusted to 3.0 at 40° C. and maintained at that value throughout the precipitation.

FIGS. *2a* and *2b* are scanning electron micrographs of the resulting AgClBr (40 mole percent bromide) grains with triangular holes.

Examples 6, 7, 8 and 9

Examples 6 through 9 were prepared as described in Example 1, except that Rousselot gelatin (non-oxidized, containing 59.7 micro moles of methionine per gram of initial gelatin) was used instead of oxidized gelatin, and the amount of chloride and bromide in solution was varied, resulting in different chloride to bromide ratios in the resultant grains, as shown in Table I. For example, in Example 8, 31 grams of NaBr instead of 9.3 grams was added initially to the reaction vessel solution resulting in a grain having a chloride to bromide ratio of 80:20. The pH was adjusted to 5 at 40° C. and maintained at that value throughout the precipitation. FIGS. *3a* and *3b* are scanning electron micrographs of the silver chlorobromide (20 mole percent bromide) grains resulting from Example 8, having round shaped holes.

TABLE I

| Example No. | Cl/BR Ratio | pH | Gelatin Type | Hole Area Per Grain | Hole Shape | Hole Percent | Hole Size |
|---|---|---|---|---|---|---|---|
| 1 | 94/6 | 4 | oxidized gelatin | random | irregular | >90 | <3.0 |
| 2 | 60/40 | 5 | oxidized gelatin | random | irregular | >90 | <3.0 |
| 3 | 97/3 | 5 | oxidized gelatin | random | irregular | >90 | <1.5 |
| 4 | 98.5/1.5 | 5 | oxidized gelatin | 4% | round | >90 | <3.5 |
| 5 | 60/40 | 3 | oxidized gelatin | 45% | triangular | >90 | <2.0 |
| 6 | 90.2/9.8 | 5 | Rousselot gelatin | 33% | round | >90 | <2.0 |
| 7 | 85/15 | 5 | Rousselot gelatin | 40% | round | >90 | <2.0 |
| 8 | 80/20 | 5 | Rousselot gelatin | 44% | round | >90 | <2.0 |
| 9 | 80/20 | 5 | Rousselot gelatin | 48% | round | >90 | <3.0 |

Example 10. AgCl(94%)Br(6%) Emulsion with no holes (Control)

This emulsion was prepared in the same manner as Example 1, except that no 378 cc of $CaCl_2$ was introduced. The resulting emulsion exhibited no hole formation in the grains. This example demonstrates that the introduction of a chloride containing compound (after formation of a grain having a high solubility periphery and a low solubility central portion) is essential to hole formation.

Example 11. AgCl T-Grain Emulsion (Control)

This emulsion was prepared in tile same way as Example 6 (9.8 mole percent AgBr, 90.2 mole percent Cl) except that no bromide was added in the reaction vessel. The resulting emulsion shows no holes in the grains. This example demonstrates that, in the case of chlorobromide grains, a central bromide containing portion is necessary for hole formation to occur using the method of the invention.

Example 12. Tabular AgCl(60%) BR(40%) grains made with 4,5,6-Triaminopyrimidine

Figure 4:
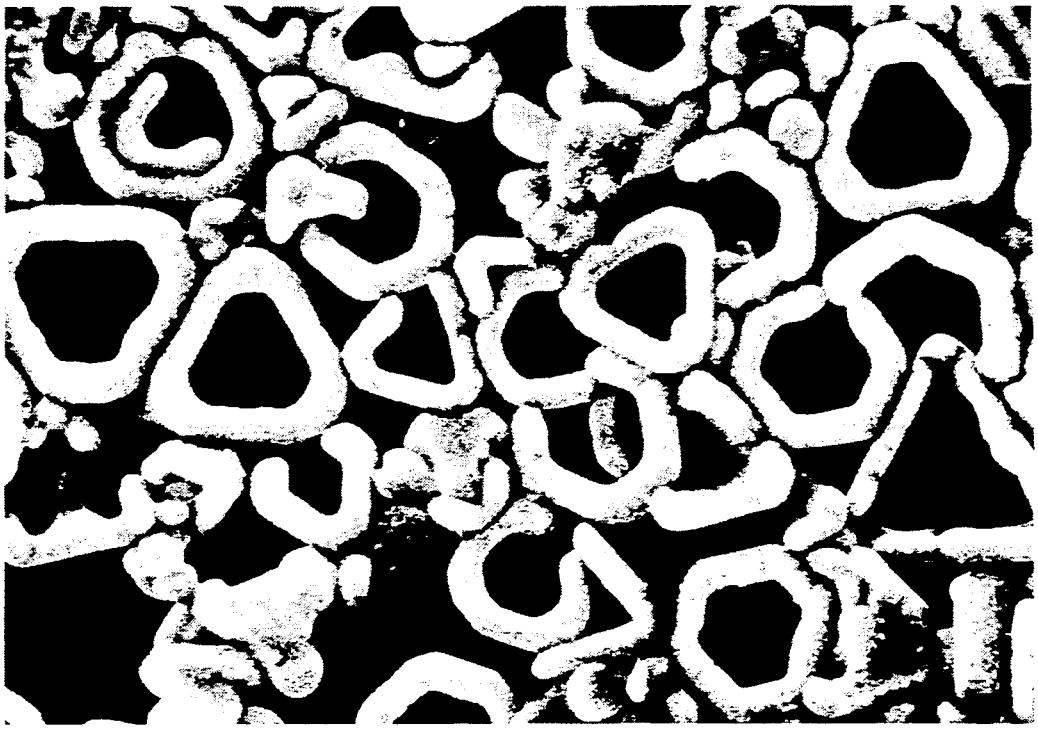
FIG. 4 is a scanning electron micrograph of a tabular silver halide grain produced in accordance with the method disclosed in Example 12.

This emulsion was prepared in the same way as Example 1 except that 200 cc of 20 Mm 4,5,6 triaminopyrimidine and 62 grams of NaBr were added to the reaction vessel. Furthermore, 100 cc of 20 Mm of triaminopyrimidine solution was used instead of adenine solution during the course of precipitation. The resulting grains were 2.0 μm in diameter and exhibited centrally located round shaped holes of about 1.5 μm in diameter. The grains with holes therein account for more than 80% of the total population of grains. FIG. 4 is a scanning electron micrograph of the resulting AgClBr grains having round holes.

Thus, the invention as disclosed herein provides a means for preparing tabular silver chlorobromide emulsions leaving holes in the grams. When layers of the tabular emulsion produced in accordance with the invention are coated on photographic film or paper, the free flow of developer solution can potentially be facilitated by channeling and capillary effects caused by the holes in tile grains. Thus, the uniformity and speed of development can be improved. By varying various parameters during precipitation, the size and shape of the holes can be manipulated.

Figure 2A:
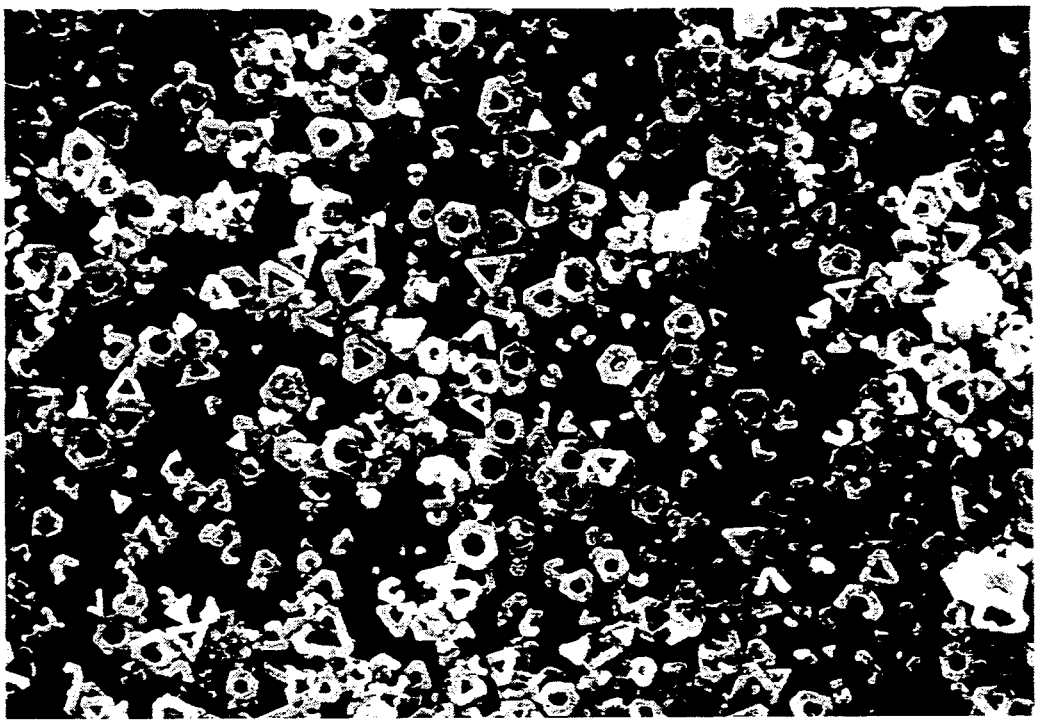
FIGS. 2*a* and 2*b* are scanning electron micrographs of tabular silver halide grains produced in accordance with the method disclosed in Example 5.
Figure 2B:
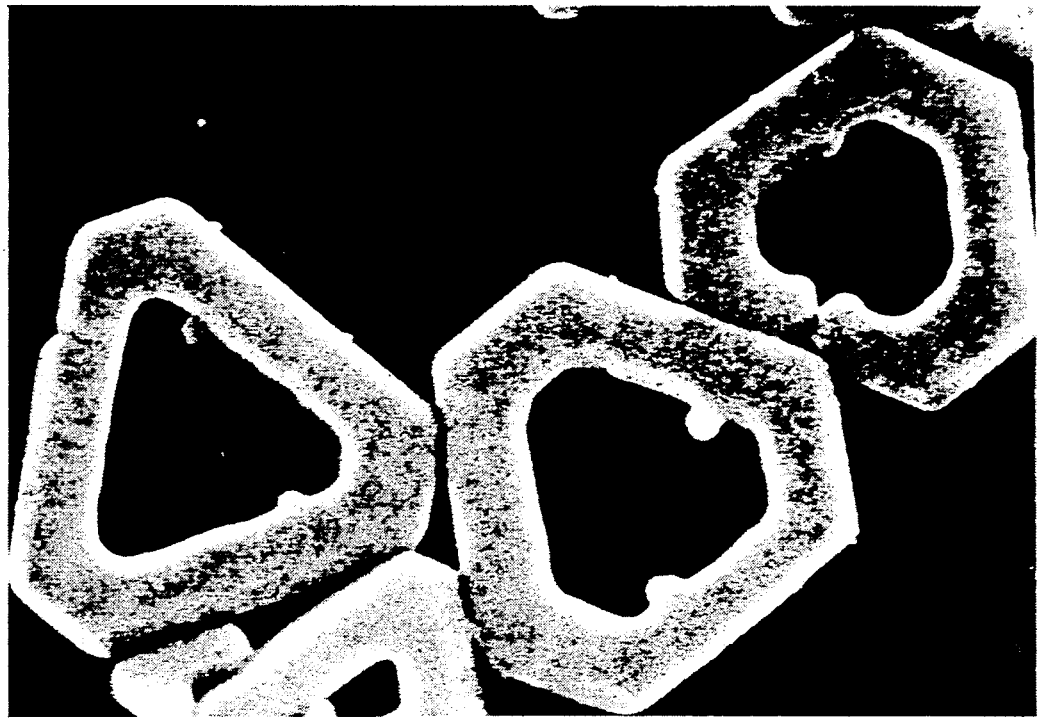
Figure 3A:
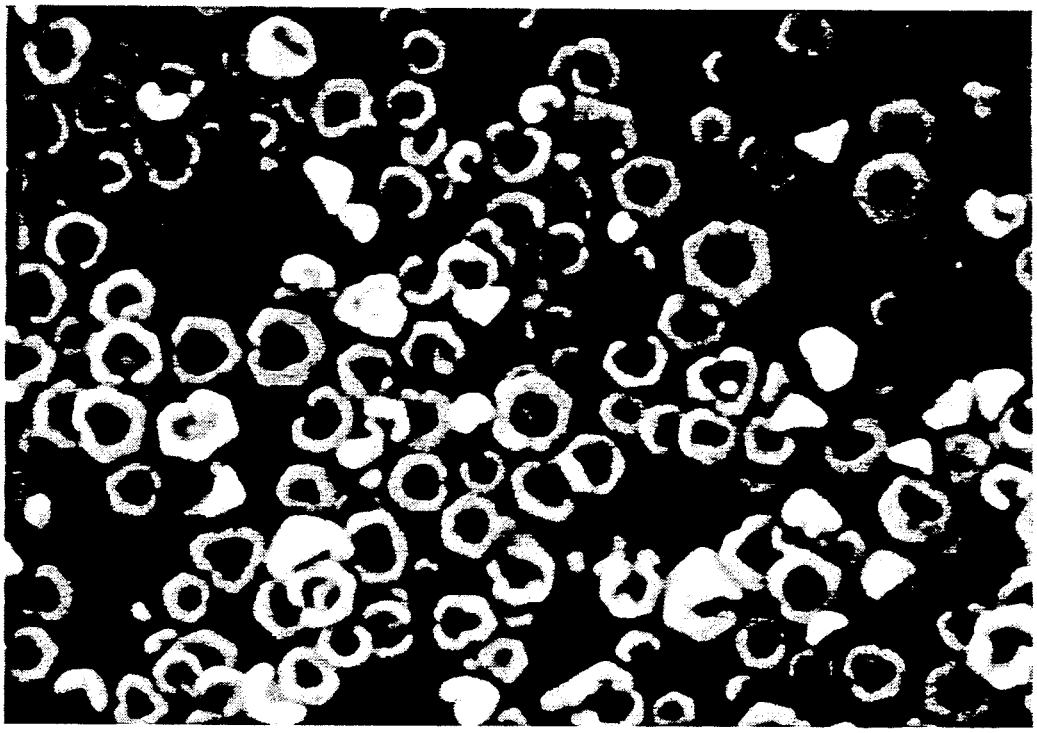
FIGS. 3*a* and 3*b* are scanning electron micrographs of tabular silver halide grains produced in accordance with the method disclosed in Example 8.
Figure 3B:
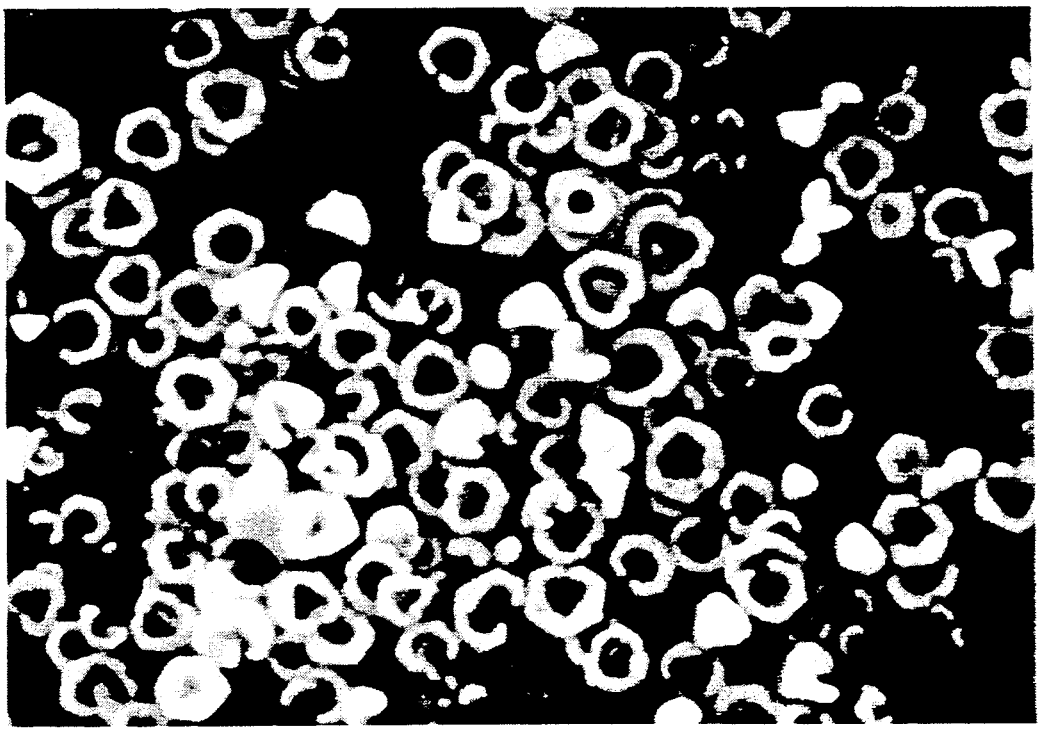

For example, by maintaining a low pH and a high bromide content (such as 40 mole percent) during the precipitation process, triangular and hexagonal shaped holes can be formed, as illustrated in Example 5 of Table 1, and FIG. 2. Further, in comparing precipitation processes having relatively the same parameters, lower bromide contents typically result in smaller holes. However, other techniques, such as the utilization of extra ripening steps, can be used to make larger holes even with lower bromide contents.

The invention has been described in detail with particular reference to preferred embodiments thereof, but it will be understood that variations and modifications can be effected within the spirit and scope of the invention.

What is claimed is:

1. A process for producing a radiation-sensitive emulsion containing silver halide tabular grains having {111} major crystal faces with a centrally-located hole, said process comprising providing an emulsion containing tabular grains comprised of silver chloride and silver bromide, having a center portion and a peripheral portion surrounding said center portion, wherein said peripheral portion has a higher solubility than said center portion;

adding a grain protecting material having a purine type molecular structure to said emulsion to adsorb onto said peripheral portion of said silver chlorobromide grains; and increasing the chloride ion concentration of said emulsion, whereby said center portion is removed, creating a hole in said grain.

2. A process according to claim 1, wherein said providing an emulsion comprises:

providing an emulsion containing chloride ions and bromide ions; and adding a quantity of a silver containing compound to said emulsion, so that a quantity of silver halide grains is formed, the center of said silver halide grains having a center portion and a peripheral portion, said peripheral portion having a higher solubility than said center portion.

3. A process according to claim 2, wherein said emulsion containing chloride and bromine ions comprises at least 60% chloride ions.

4. A process according to claim 2, wherein said emulsion containing chloride and bromine ions comprises at least 80% chloride ions.

5. A process according to claim 2, wherein said emulsion containing chloride and bromine ions comprises at least 90% chloride ions.

6. A process according to claim 1, wherein said increasing the chloride ion concentration results in a drop of pCl greater than 0.05.

7. A process according to claim 1, wherein said increasing the chloride ion concentration results in a drop of pCl greater than 0.1.

8. A process according to claim 1, wherein said grain protecting material is selected from the group consisting of xanthine, 7-azaindole, adenine, 4,5,6 triaminopyrimidine, and mixtures thereof.

9. A process according to claim 1, wherein said grain protecting material has the following formula:

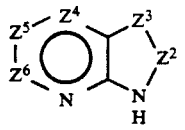

where $Z^2$ is —C($R^2$)=or —N=;

$Z^3$ is —C($R^3$)=or —N=;

$Z^4$ is —C($R^4$)=or —N=;

$Z^5$ is —C($R^5$)=or —N=;

$Z^6$ is —C($R^6$)=or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

10. A process according to claim 1, wherein said grain protecting material has the following formula:

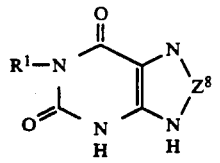

where $Z^8$ is —C($R^8$)=or —N=;

$R^8$ is H, $NH_2$ or $CH_3$; and $R^1$ is hydrogen or a hydrocarbon containing from 1 to 7 carbon atoms.

11. A process according to claim 1, wherein said grain protecting material is a 2-hydroaminoazine of the following formula:

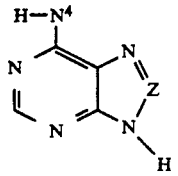

where $N^4$ is an amino moiety and

Z represents the atoms completing a 5 or 6 member ring.

12. A process according to claim 1, wherein said increasing the chloride ion concentration of said emulsion comprises adding a chloride-containing salt.

13. A process according to claim 12, wherein said chloride-containing salt is calcium chloride.

14. A process of producing a radiation-sensitive emulsion containing silver halide tabular grains with a centrally-located hole, said process comprising:

providing, in a dispersing medium, silver halide grains having a total projected area of which at least 50 percent is provided by tabular silver halide grains which are more than 50 mole percent silver chloride, with a thickness of less than 0.3 μm, a diameter of at least 0.6 μm, and a mean aspect ratio greater than 8:1, wherein the silver halide tabular grains are bordered by opposed, substantially parallel {111} major crystal faces and at least 50 percent of the tabular silver halide grains have a centrally-located region, surrounded radially by a peripheral region, wherein the centrally-located region comprises a silver halide which is less soluble than the silver halide of the peripheral region;

adding a grain protecting material having a purine type molecular structure to said dispersing medium to adsorb onto said peripheral region of said grain; and increasing the chloride ion concentration in said dispersing medium under conditions effective to remove the less soluble centrally-located region and form a centrally-located hole in the silver halide tabular grains, connecting the substantially parallel {111} major crystal faces, wherein the centrally-located hole has a diameter of at least 0.4 μm and constitutes less than 75 percent of the silver halide tabular grain diameter.

15. A process according to claim 14, wherein the dispersing medium comprises a gelatin peptizer.

16. A process according to claim 14, wherein the centrally-located region of said provided silver halide grains contains at least 12 mole % more of the less soluble silver halide than in the peripheral region.

17. A process according to claim 16, wherein the peripheral region of said provided silver halide grains include at least 60 mole % chloride.

18. A process according to claim 17, wherein the centrally-located region of said provided silver halide grains is substantially silver bromide.

19. A process according to claim 17, wherein the peripheral region of said provided silver halide grains is substantially silver chlorobromoiodide.

20. A process according to claim 16, wherein the halides of the peripheral region of said provided silver halide grains include at least 80% chloride.

21. A process according to claim 16, wherein the halides of the peripheral region of said provided silver halide grains include at least 90% chloride.

22. A process according to claim 14, wherein the peripheral region of said provided silver halide grains is substantially silver chlorobromide.

23. A process according to claim 14, wherein said increasing the chloride ion concentration comprises adding a chloride-containing salt.

24. A process according to claim 23, wherein said chloride containing salt is calcium chloride.

* * * * *